US008150543B2

(12) United States Patent
Jameson et al.

(10) Patent No.: US 8,150,543 B2
(45) Date of Patent: Apr. 3, 2012

(54) METHODS, APPARATUS AND ARTICLES FOR AN AIR JET LOOM

(75) Inventors: John Wingate Jameson, Berkeley, CA (US); Sarah Elizabeth Peach, Kensington, CA (US)

(73) Assignee: Siemens Aktiengesellschaft, München (DE)

( * ) Notice: Subject to any disclaimer, the term of this patent is extended or adjusted under 35 U.S.C. 154(b) by 870 days.

(21) Appl. No.: 12/210,756

(22) Filed: Sep. 15, 2008

(65) Prior Publication Data

US 2009/0151806 A1 Jun. 18, 2009

Related U.S. Application Data

(60) Provisional application No. 60/995,780, filed on Sep. 28, 2007.

(51) Int. Cl.
*G06F 19/00* (2011.01)

(52) U.S. Cl. ..... 700/140; 139/435.2

(58) Field of Classification Search ..... 700/140; 139/435.2, 435.5

See application file for complete search history.

(56) References Cited

U.S. PATENT DOCUMENTS

| | | | | |
|---|---|---|---|---|
| 4,342,340 | A | 8/1982 | Key et al. | |
| 4,699,182 | A | 10/1987 | Allen | |
| 4,703,779 | A | 11/1987 | Philippe et al. | |
| 5,034,897 | A * | 7/1991 | Sainen | 700/140 |
| 5,060,161 | A * | 10/1991 | Sainen | 700/140 |
| 5,224,520 | A * | 7/1993 | Shinbara et al. | 139/116.2 |
| 5,276,627 | A * | 1/1994 | Makino et al. | 700/140 |
| 5,321,621 | A * | 6/1994 | Sainen | 700/140 |
| 5,476,122 | A * | 12/1995 | Schuster et al. | 139/194 |
| 5,553,641 | A * | 9/1996 | Zenoni | 139/452 |
| 5,676,177 | A * | 10/1997 | Shofner et al. | 139/1 C |
| 6,269,282 | B1 | 7/2001 | Burger et al. | |
| 6,328,081 | B1 * | 12/2001 | Gotti et al. | 139/450 |
| 6,467,512 | B1 * | 10/2002 | Meyer et al. | 139/435.2 |
| 7,063,109 | B2 | 6/2006 | Siegl et al. | |
| 7,110,847 | B2 * | 9/2006 | Ostyn | 700/140 |

(Continued)

FOREIGN PATENT DOCUMENTS

DE 4137681 A1 5/1992

(Continued)

OTHER PUBLICATIONS

U.S. Appl. No. 12/288,043 to Jan Colditz et al., filed Oct. 16, 2008.

(Continued)

*Primary Examiner* — Danny Worrell
(74) *Attorney, Agent, or Firm* — Donald B. Paschburg

(57) ABSTRACT

In some embodiments, a method includes providing a first controller; providing a second controller; using the second controller to control a plurality of valves to provide a sequence of air jets that propel a weft thread across at least a portion of a weft insertion region of an air jet loom; and using the first controller to control at least one aspect of the air jet loom not controlled by the second controller. In some embodiments, a method for a controller in an air jet loom includes (a) defining a reference loom configuration; (b) determining a characterization of the reference loom configuration; (c) determining a modified loom configuration by at least one change to the reference loom configuration; (d) determining a characterization of the modified loom configuration; and (e) revising the reference loom configuration if the characterization of the modified loom configuration satisfies a criteria.

24 Claims, 8 Drawing Sheets

U.S. PATENT DOCUMENTS

| | | | | |
|---|---|---|---|---|
| 7,584,014 | B2 * | 9/2009 | Gotti et al. | 700/140 |
| 2005/0203659 | A1 | 9/2005 | Siegl | |
| 2009/0151806 | A1 * | 6/2009 | Jameson et al. | 139/435.2 |

FOREIGN PATENT DOCUMENTS

| | | | |
|---|---|---|---|
| EP | 0344104 | A1 | 5/1989 |
| EP | 037T483 | A2 | 6/1990 |
| EP | 0493328 | A1 | 7/1992 |
| EP | 0333T55 | A2 | 9/1999 |
| EP | T990450 | A2 | 11/2008 |

OTHER PUBLICATIONS

Dr. Sabit Adanur et al., "Characterization of Air-Yarn Interface in Air-Jet Weaving", Annual Report—Oct. 1, 1999, National Textile Center Annual Report: Nov. 1999, F99-A10, p. 1-7.

M. Cengiz Kayacan et al., "Velocity Control of Weft Insertion on Air Jet Looms by Fuzzy Logic", Fibres & Textiles in Eastern Europe, Jul./Oct. 2004, vol. 12, No. 3(47), pp. 29-33, (5 pages total).

* cited by examiner

METHODS, APPARATUS AND ARTICLES FOR AN AIR JET LOOM

CROSS-REFERENCE TO RELATED APPLICATION

This application claims priority under 35 U.S.C. §119 to U.S. Provisional Patent Application Ser. No. 60/995,780, entitled "Air Valve Sub-Controller For An Air Jet Loom", filed on Sep. 28, 2007, the contents of which are hereby incorporated by reference in their entirety for all purposes.

TECHNICAL FIELD

The present disclosure relates to methods, apparatus and/or articles for an air jet loom.

BACKGROUND

In an air jet loom, a sequence of air jets propel a weft yarn (sometimes referred to as weft thread) across a weft insertion region to fabricate a weave. The sequence of air jets are typically controlled via a plurality of valves (sometimes referred to herein as air jet valves), which are typically turned on (sometimes referred to as activated) in rapid succession as the weft thread traverses the weft insertion region.

The sequence of air jets are typically precisely timed, to help ensure that the weft yarn is reliably propelled across the weft insertion region, i.e., completely across the weft insertion region. If a valve associated with a particular air jet is turned on too soon the weft yarn will "bounce off" that particular air jet. If the valve is turned on too late, the weft yarn will sink before it can be "captured" and propelled by the air jet.

Many air jet looms use a microcontroller to operate the air jet loom, including the turn on (or activation) of the air jet valves. Because the air jet valves are typically activated in rapid succession, and because the weft may travel at a relatively high speed, typically around 50 meters per second (m/sec), the microcontroller uses a high speed bus with a very fine timescale of communication to control the air jet valves.

The timing that is desired for the air jets typically depends at in part on the characteristics of the weft yarn, which can vary from roll to roll. Thus, a manual adjustment is typically made to the timing each time a new roll of thread is started.

SUMMARY

It has been determined that the high speed bus and fine timescale of communication to the air jet valves implies a higher cost for the microcontroller than would occur if the microcontroller did not have a high speed bus and fine timescale requirement.

It has also been determined that the manual adjustment (sometimes referred to herein as manual tuning) each time a new roll of thread is started typically entails a substantial amount of time and labor, and often results in unreliable performance.

According to a first aspect, a method includes providing a first controller; providing a second controller; using the second controller to control a plurality of valves to provide a sequence of air jets that propel a weft thread across at least a portion of a weft insertion region of an air jet loom; and using the first controller to control at least one aspect of the air jet loom not controlled by the second controller.

According to another aspect, a method for a controller in an air jet loom includes (a) defining a reference loom configuration; (b) determining a characterization of the reference loom configuration; (c) determining a modified loom configuration by at least one change to the reference loom configuration; (d) determining a characterization of the modified loom configuration; and (e) revising the reference loom configuration if the characterization of the modified loom configuration satisfies a criteria.

According to another aspect, an apparatus includes a first controller; a second controller; the second controller to control a plurality of valves to provide a sequence of air jets that propel a weft thread across at least a portion of a weft insertion region of an air jet loom; and the first controller to control at least one aspect of the air jet loom not controlled by the second controller.

According to another aspect, an apparatus includes a controller for an air jet loom, the controller to: (a) define a reference loom configuration; (b) determine a characterization of the reference loom configuration; (c) determine a modified loom configuration by at least one change to the reference loom configuration; (d) determine a characterization of the modified loom configuration; and (e) revise the reference loom configuration if the characterization of the modified loom configuration satisfies a criteria.

According to another aspect, an article for an air jet loom having a first controller and a second controller, the article including a storage medium readable by the second controller, the storage medium having instructions stored thereon that if executed by the second controller, the second controller controls a plurality of valves to provide a sequence of air jets that propel a weft thread across at least a portion of a weft insertion region of an air jet loom; wherein the first controller controls at least one aspect of the air jet loom not controlled by the second controller.

According to another aspect, an article for an air jet loom having a controller, the article including a storage medium readable by the controller, the storage medium having instructions stored thereon that if executed by the controller result in the following: (a) defining a reference loom configuration; (b) determining a characterization of the reference loom configuration; (c) determining a modified loom configuration by at least one change to the reference loom configuration; (d) determining a characterization of the modified loom configuration; and (e) revising the reference loom configuration if the characterization of the modified loom configuration satisfies a criteria.

Some embodiments reduce the overall cost of the air jet loom by adding a second microcontroller to activate the air jet valves, thereby reducing the performance requirements and hence the cost of the first microcontroller by reducing and/or eliminating the need for a fine timescale of communication between the first microcontroller and the air jet valves.

Some embodiments increase the reliability of weft insertion and hence cloth quality by enabling more accurate control of the valve timings.

Some embodiments offer the capability of automatically finding reliable and efficient timing control settings of the valves, reducing and/or eliminating the need for costly and time-consuming manual intervention.

Although various features, attributes and/or advantages may be described herein and/or may be apparent in light of the description herein, it should be understood that unless stated otherwise, such features, attributes and/or advantages are not required and need not be present in all aspects and/or embodiments.

BRIEF DESCRIPTION OF THE DRAWINGS

Various embodiments will be apparent from the following detailed description and accompanying drawings, in which like reference numerals designate like parts, and wherein.

DETAILED DESCRIPTION

Figure 1:
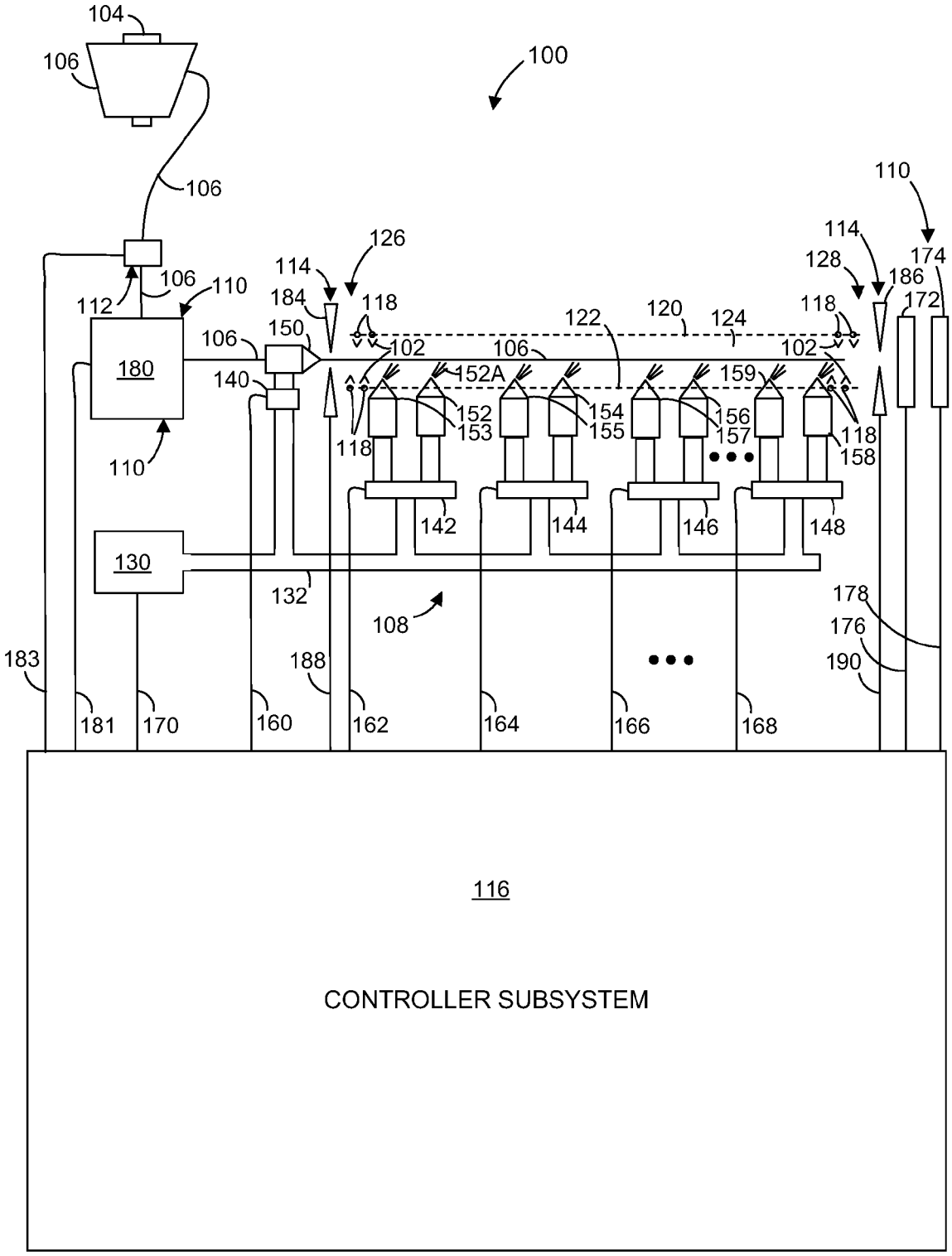
FIG. 1 is a schematic view of a portion of an air jet loom, in accordance with some embodiments.

FIG. 1 is a schematic view of a portion of an air jet loom 100, in accordance with some embodiments. Referring to FIG. 1, in accordance with some embodiments, an air jet loom 100 comprises a loom, a portion of which is indicated at 102, a support 104 for a roll of weft thread 106, an air jet subsystem 108, a weft speed sensor subsystem 110, a brake subsystem 112, a cutting subsystem 114 and a controller subsystem 116. (It should be understood that the loom is not limited to that which is shown in FIG. 1. It should also be understood that some components shown in FIG. 1 may have additional portions that do not appear in FIG. 1.)

The loom 102 supports a plurality of warp threads 118. Some of the warp threads 118 may be disposed in a first warp plane 120. Others of the warp threads 118 may be disposed in a second warp plane 122. A weft insertion region 124 is disposed between the first warp plane 120 and the second warp plane 120. The weft insertion region 124 may have a first side 126 and a second side 128. The first warp plane 120 and the second warp plane 122 may converge and define an angle (not shown). The controller subsystem 116 may control the loom 102 so as to position each of the warp threads 118 in an appropriate one of the warp planes 120, 122 so as to result in fabric having a desired pattern.

The air jet subsystem 108 includes a gaseous air supply 130 that is in flow communication with, and supplies air to, a distribution network 132, which is, in turn, in flow communication with, and supplies the air to, a plurality of valves, represented by valves 140-148 (i.e., valves 140, 142, 144, 146 and 148). Each of the plurality of valves is in flow communication with at least one nozzle. In the illustrated embodiment, a valve 140, sometimes referred to herein as a main valve, is in flow communication with a nozzle 150, sometimes referred to herein as a main nozzle 150. The other valves, represented by valves 142-148, are sometimes referred to herein as slave valves. In the illustrated embodiments, a valve 142, sometimes referred to herein as slave valve 0, is in flow communication with nozzles 152-153. A valve 144, sometimes referred to herein as slave valve 1, is in flow communication with nozzles 154-155. A valve 146, sometimes referred to herein as slave valve 2, is in flow communication with nozzles 156-157. A valve 148, sometimes referred to herein as slave valve N−1, is in flow communication with nozzles 158-159.

Each valve may include an actuator (not shown) to open (sometimes referred to herein as "turn on") and/or close (sometimes referred to herein as "turn off") the valve. The actuator may include one or more power transistors. If a valve is open, each of the at least one nozzle in flow communication with that valve receives a portion of the air supplied to the valve and provides such air as an air jet (i.e., a jet of air). For example, the nozzle 152 receives a portion of the air supplied to the valve 142 and provides such air as an air jet 152A. If a valve is closed, the at least one nozzle in flow communication with that valve does not receive the air supplied to the valve and thus does not supply an air jet.

The plurality of valves 140-148 are electrically connected to the controller subsystem 116 by a plurality of signals lines 160-168, respectively. As further described below, each of the plurality of valves 140-148 may receive a control signal via the respective one of the signal lines 160-168. The control signal received by a valve may be supplied to one or more power transistors in an actuator of that valve and may cause the actuator to open and/or close that valve.

The control signals supplied by the controller subsystem 116 control the plurality of the valves (to open and/or close) so as to provide a sequence of air jets (from the nozzles) that propel the weft yarn across the weft insertion region 124.

The main valve is sometimes said to control the main air nozzle, which provides the initial propulsion of the weft thread 106 into the traverse area. In some embodiments, the main valve is turned on at the start of a loom cycle and kept on throughout the weft traverse of the weft insertion region 124, sometimes referred to as "weft traverse". Slave valves may or may not be equally spaced apart from one another. Activation of a slave valve is sometimes referred to as a slave event.

The gaseous air supply 130 may be electrically connected to the controller subsystem 116 by a signal line 170. The gaseous air supply 130 may receive a control signal via the signal line 170. The control signal received by the gaseous air supply 130 may be supplied to an actuator of the gaseous air supply 130 to control an air pressure thereof.

The sensor subsystem 110 may include a first weft presence sensor 172 and a second weft presence sensor 174, disposed at first and second positions, respectively, on the second side 128 of the weft insertion region 124. The first presence sensor 172 detects whether the weft has reached the first position (indicating that the weft has traversed the weft insertion region 124) and supplies a signal indicative thereof. In some embodiments, the signal comprises a pulse. In some embodiments, the first weft position sensor is capable of supplying up to about 30 pulses per second (pulses/sec) corresponding with up to about 30 weft traversals per second.

The second presence sensor 174 detects whether the weft has reached the second position (indicating that the weft thread 106 has traversed the weft insertion region 124 and broken) and supplies a signal indicative thereof. In some embodiments, the signal comprises a pulse. In some embodiments, the second weft position sensor is capable of supplying up to about 30 pulses per second (pulses/sec) corresponding with up to about 30 weft traversals and breaks per second. It should be noted that if the weft makes the full traverse (i.e., completely across the weft insertion region 124) but doesn't break, then the end of the weft will not reach the second weft presence detector.

The first presence sensor 172 and the second presence sensor 174 may be electrically connected to the controller subsystem 116 by signal lines 176, 178, respectively, which may supply the signals from the presence sensors 172, 174 to the controller subsystem 116.

The sensor subsystem 110 may include a weft speed sensor 180 that supplies signal, sometimes referred to herein as the weft speed signal, which in some embodiments, may be used to determine the speed of the weft. In some embodiments, the weft speed signal comprises a series of pulses, where the first pulse indicates that the weft has traveled a defined distance and each additional pulse indicates that the weft has traveled an additional increment equal to the defined distance. In some embodiments, the defined distance is sometimes referred to as the resolution of the weft speed sensor 180.

In some embodiments, the defined distance is equal to 4 millimeters (mm). Thus, the weft speed signal may comprise a pulse for every 4 mm of weft travel. In some such embodiments, the weft speed signal comprises zero to 25,000 pulses/second (pulses/sec).

In the description below, distances are sometimes expressed in terms of ticks, where a tick is defined as a unit distance of 4 mm (i.e., the resolution of some weft position sensors). Some embodiments use this unit of measurement, as a matter of convenience, even if a weft speed sensor 180 is not included in the air jet loom 100. In some embodiments, a full traverse requires that the weft travel a distance of about 2.5 meters (m) or about 625 ticks.

The weft speed sensor 180 may be electrically connected to the controller subsystem 116 by a signal line 181, which may supply the weft speed signal from the weft speed sensor 180 to the controller subsystem 116.

In some embodiments, the weft speed sensor 180 comprises a weft sensor manufactured by ELTEX of Sweden.

The brake subsystem 112, sometimes referred to as brake 112, is disposed on the first side 126 of the weft insertion region 124. The brake 112 may be electrically connected to the controller subsystem 116 by a signal line and may receive a control signal, via the signal line 183, which may cause the brake 112 to increase and/or decrease an amount of force applied by the brake 112.

The cutting subsystem 114 may include a first cutter 184 disposed on the first side 126 of the weft insertion region 124 and a second cutter 186 disposed on the second side 128 of the weft insertion region 124. The first cutter 184 and the second cutter 186 may be electrically connected to the controller subsystem 116 by signals lines 188, 190, respectively. The first cutter 184 may receive a control signal, via the respective signal line 188, which may cause the first cutter 184 to cut the weft thread 106 on the first side 126 of the weft insertion region 124. The second cutter 186 may receive a control signal, via the respective signal line 190, which may cause the first cutter 184 to cut the weft thread 106 on the second side 128 of the weft insertion region 124.

It should be understood that although each of the signals are shown supplied on a single signal line, each of such signals, and/or any other signals described herein, may have any form including for example but not limited to, a single ended digital signal, a differential digital signal, a single ended analog signal and/or a differential analog signal.

Figure 2A:
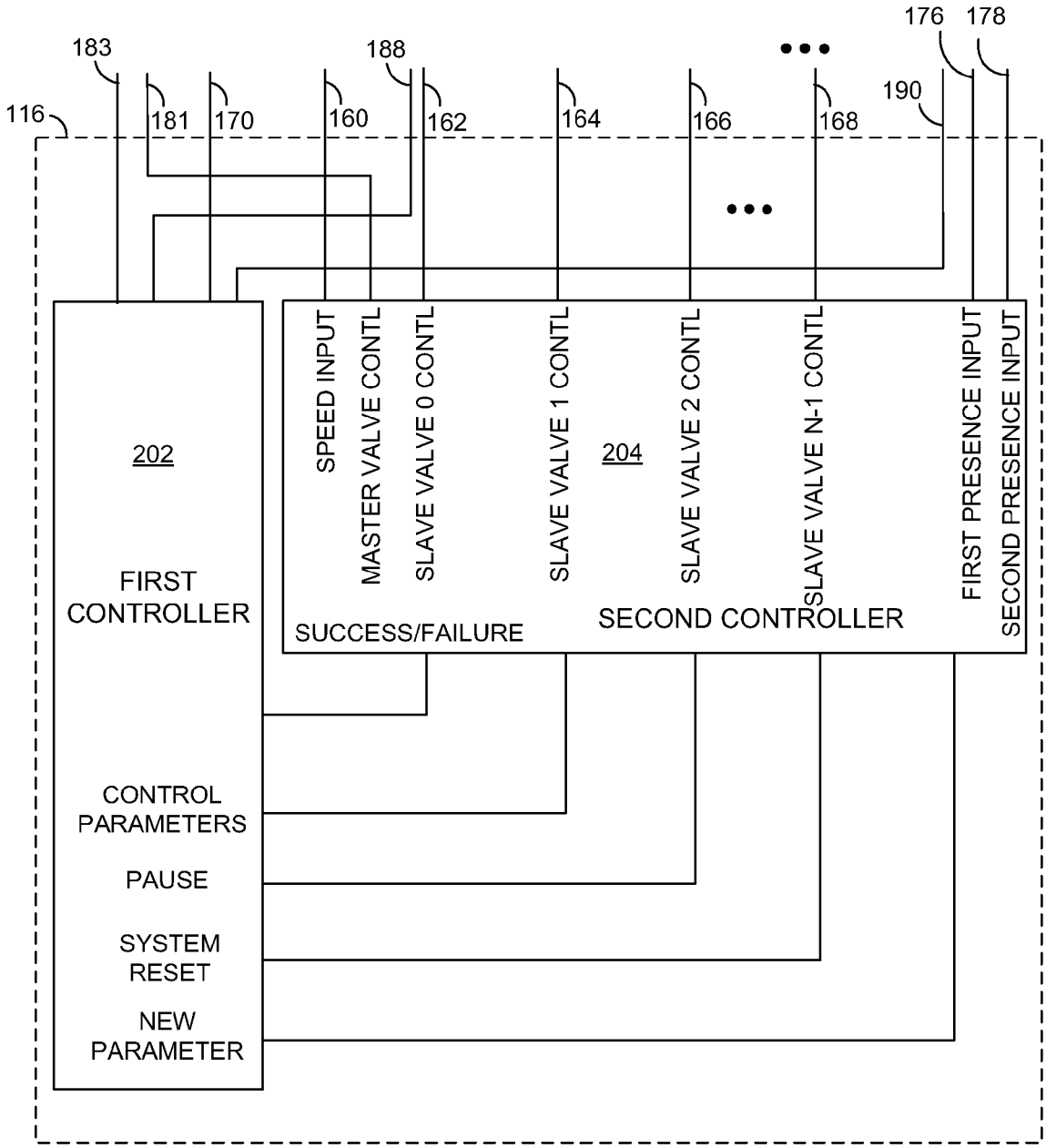
FIG. 2A is a schematic block diagram of a controller subsystem for an air jet loom, in accordance with some embodiments.

FIG. 2A is a schematic block diagram of the controller subsystem 116, in accordance with some embodiments. Referring to FIG. 2A, the controller subsystem 116 may include a first controller 202 and a second controller 204. In accordance with some embodiments, the second controller 204 controls the plurality of the valves, represented by valves 140-148, (to open and/or close) so as to provide a sequence of air jets (from the nozzles) that propel the weft yarn across the weft insertion region 124. The first controller 202 may control one, some or all other aspects of the air jet loom 100.

As used herein, a controller may comprise any type of controller. For example, a controller may be programmable or non programmable, general purpose or special purpose, dedicated or non dedicated, distributed or non distributed, shared or not shared, and/or any combination thereof. A controller may include, but is not limited to, hardware, software, firmware, and/or any combination thereof. Hardware may include, but is not limited to off the shelf integrated circuits, custom integrated circuits and/or any combination thereof. In some embodiments, a controller comprises a microcontroller, which may in turn comprise a microprocessor. Software may include, but is not limited to, instructions that are storable and/or stored on a computer readable medium, such as, for example, punch cards, paper tape, magnetic or optical disk, magnetic or optical tape, CD-ROM, DVD, RAM, EPROM, or ROM. A controller may employ continuous signals, periodically sampled signals, and/or any combination thereof. If a controller is distributed, two or more portions of the controller may communicate with one another through a communication link.

As used herein, a communication link may comprise any type of communication link, for example, but not limited to wired (e.g., conductors, fiber optic cables) or wireless (e.g., acoustic links, electromagnetic links or any combination thereof including, for example, but not limited to microwave links, satellite links, infrared links), and/or any combinations thereof. A communication link may be public or private, dedicated and/or shared (e.g., a network) and/or any combination thereof. A communication link may or may not be a permanent communication link. A communication link may support any type of information in any form, for example, but not limited to, analog and/or digital (e.g., a sequence of binary values, i.e. a bit string) signal(s) in serial and/or in parallel form. The information may or may not be divided into blocks. If divided into blocks, the amount of information in a block may be predetermined or determined dynamically, and/or may be fixed (e.g., uniform) or variable. A communication link may employ a protocol or combination of protocols including, for example, but not limited to the Internet Protocol.

Software that includes instructions to be executed by a controller to perform one or more portions of one or more processes may be stored by any controller readable medium, for example, punch cards, paper tape, magnetic or optical disk, magnetic or optical tape, CD-ROM, DVD, RAM, EPROM, or ROM. The controller readable medium may be and/or may be included in, an article of manufacture.

The second controller 204 may supply a plurality of control signals to control the plurality of valves, represented by valves 140-148. The plurality of control signals may include a first control signal, indicated as master valve control, to control the master valve 140 (FIG. 1). The plurality of control signals may further include N control signals to control the N slave valves 142-148 (FIG. 1). The N control signals to control the slave valves, represented by valves 142-148, may include a first control signal, indicated as slave valve 0 control, to control the first slave valve 142 (FIG. 2), a second control signal, indicated as slave valve 1 control, to control the second slave valve 144 (FIG. 1), a third control signal, indicated as slave valve 2 control, to control the third slave valve 146 (FIG. 1), and an Nth control signal, indicated as slave valve N−1 control, to control the Nth slave valve 148 (FIG. 1). In some embodiments, the second controller 204 communicates to the other subsystems of the air jet loom 100 only via such valve control signals.

In some embodiments, the second controller 204 further supplies a signal, sometimes referred to herein as a success/failure signal, to indicate whether the weft thread 106 successfully traversed the weft insertion region 124. In some embodiments, the success/failure signal is generated based at least in part on the signals from the sensor subsystem 110. In that regard, the second controller 204 may include one or more input ports to receive the signal supplied by the first presence sensor 172, the signal supplied by the second presence sensor 174 and/or the signal supplied by the weft speed sensor 180.

In some embodiments, the second controller 204 further receives a cycle start pulse. In some embodiments, each cycle of the loom corresponds to a new weft insertion, or at least an attempted insertion. In some embodiments, the cycle start pulse has a maximum rate of about 23 pulses/sec.

In some embodiments, the second controller 204 generates the success/failure signal for each cycle. If the weft makes it across the traverse a traverse success pulse is sent to the second controller 204. If the weft is estimated to have passed a certain distance but no traverse success pulse has been received, or alternatively if a pre-specified amount of time has passed but no traverse pulse has been received, then a traverse failure condition is established within the second controller 204 for the corresponding cycle.

The first controller 202 may supply one or more control signals to control one, some or all aspects of the air jet loom 100 not controlled by the second controller 204. In some embodiments, the control signals may include a first control signal, which may be supplied on signal line 183, to control the brake 112 (FIG. 1), a second control signal, which may be supplied on signal line 188, to control the first cutter 184 (FIG. 1), a third control signal, which may be supplied on signal line 170, to control the air pressure of the air jet subsystem 108 (FIG. 1), and a fourth control signal, which may be supplied on signal line 190, to control the second cutter 186 (FIG. 1). The one or more control signals may further include one or more other control signals (not shown) to control one or more other aspects of the air jet loom 100.

In some embodiments, the second controller may control fewer than all of the plurality of valves to provide fewer than all of the air jets that propel the weft yarn across the weft insertion region 124. In such embodiments, the first controller 202 may control one some or all others air jet valves (i.e., the valves that are not controlled by the second controller 204) to provide one some or all of the other air jets that propel the weft yarn.

In some embodiments, the second controller 204 includes a mapping that defines a relationship between positions (as measured by a speed sensor and/or as estimated in any suitable manner) of the weft thread 106 and desired states (on and/or off) of the plurality of valves 140-148. The mapping may be predetermined, adaptively determined or any combination thereof. The mapping may have any form and may be embodied in software, hardware, firmware or any combination thereof. In some embodiments, the mapping comprises a look-up table, a "curve read", a formula, hardwired logic, fuzzy logic, neural networks, and/or any combination thereof. It should be recognized that a look-up table may have many implementations including but not limited to a programmable read only memory (PROM), a programmable logic array (PLA) and/or hardwired logic.

In some embodiments, second controller 204 receives a plurality of signals from the first controller 202. The second controller 204 may use one or more of the plurality of signals in controlling the plurality of valves 140-148. The plurality of signals may include a system reset pulse, a pause pulse, a new parameters signal, and control parameters. The system reset pulse may be used to initialize the second controller 204 and may be supplied when starting a new roll of cloth. The new parameter signal may instruct the second controller 204 to read in a new set of parameters. The pause pulse may instruct the second controller 204 to stop valve activations but retain the control parameters). In some embodiments, each of the signals except for the control parameters may have the form of a one bit digital signal (e.g., a logic "1" or a logic "0, sometimes represented as [0,1]). In some embodiments, each of the signals are supplied to the second controller 204 on system initialization.

In some embodiments, the second controller 204 reads the control parameters after a system reset pulse that initializes the second controller 204.

In some embodiments, the control parameters include the control parameters listed in TABLE 1. In some embodiments, the control parameters have a value that is of a predetermined type and/or in a predetermined range of values as indicated within the brackets [ ] in TABLE 1. In some embodiments, all parameters are limited to positive integers.

TABLE 1

| PARAMETER NAME | DESCRIPTION |
|---|---|
| k_LP_filter | weft velocity (X_dot) low pass filter coefficient (typically .3). [1 byte, 255 corresponds to 1.0]; this parameter only applies if a speed sensor is present. |
| nv | Number of valves [one byte] |
| (Xv[0], Xv[1], . . . , Xv[nv − 1]) | physical valve positions (more precisely, the position of the latest possible valve-on position), relative to the position sensor [2 bytes for each position representing position in ticks] |
| np | number of control parameters [1 byte] |
| (p_lo[0], p_hi[0], p_lo[1], p_hi[1], . . . p_lo[np − 1], p_hi[np − 1]) | low and high limits of the control parameters for the adaptation search phase [2 bytes for each parameter limit (see below for more details)] |
| (p_step_size[0], p_step_size[1], . . . , p_step_size[np − 1]) | the size of each step for the corresponding parameter search [one byte for each parameter (representing ticks)] |
| X_SPAN_VENT | the distance from the latest on position to the earliest off position for any given valve [two bytes (value represents ticks)] |
| time_lag_on, time_lag_off | the effective lag times for the valve become fully on or fully off, respectively [1 byte represents milliseconds for each] |
| del_on_pulse | elapsed time for constant-on valve pulse (after which only pulse width modulation is used to hold the valve open) [1 byte (the value in milliseconds)] |
| duty_cyc_percent | duty cycle for valve hold-on phase [1 byte (255 represents 100% duty cycle)] |
| X_failure | if a success pulse has not been issued by this weft position, then it is assumed a weft insertion failure has occurred [2 bytes (the value in ticks)] |
| optimization_criteria | 0 for minimum air, 255 for maximum reliability, intermediate values for a correspondingly weighted linear combination. [1 byte] |

In some embodiments, the del_on_pulse parameter and the duty_cyc_percent parameter are supplied only if external circuitry is not used to generate the pulse width modulation.

Other mappings may also be employed.

In some embodiments, the turn on and turn off positions are determined during a tuning phase, further described below. In some embodiments, after the second controller 204 receives a set of control parameters from the first controller 202, the second controller 204 may perform an adaptive search for activation timings. In some embodiments, the adaptive search seeks the optimal valve activation timings. In some embodiments, an optimal solution is a set of valve timings where either 1) the valves are kept on the shortest amount of time, or 2) the weft makes it across the weft insertion region 124 with a minimum possibility of failure, or 3) a weighted combination of goals (1) and (2) (the weights determined by the mixing parameter given below).

As further described below, if the loom includes a weft speed sensor 180, the valve timings may be based at least in part on the weft position as determined based on the signal supplied by the weft speed sensor 180. If the loom does not include the weft speed sensor 180 the valve timings may be based at least in part on the weft position as determined by an estimated weft velocity, which in some embodiments, is assumed to be constant throughout the weft traverse.

In either case, as the weft travels across the weft insertion region 124, the position of the weft may be estimated and compared to the desired turn-on and turn-off positions of the valves. In some embodiments, for example, when the weft reaches the turn on position of the first valve (sometimes referred to as X_on[0]), the first valve is turned on, and when the weft reaches the turn off position of the first valve (sometimes referred to as X_off[0]) the first valve is turned off. The '0' index refers to the first slave valve, which as stated above, is sometimes referred to herein as slave valve 0. Similarly, a '1' index refers to the second slave valve, which as stated above, is sometimes referred to herein as slave valve 1. And so on.

In some embodiments, the speed sensor 180 measures the length of weft that passes the speed sensor 180 and rather than the position of the end of the weft (i.e., the actual position of the weft). In such embodiments, the signal from the speed sensor 180 may not necessarily indicate the actual position of the weft. For example, the weft may be passing the speed sensor 180—due to the air jet from the main nozzle—but may be broken downstream. In such case, the speed sensor 180 would indicate that the weft is moving yet the weft would be bunching up on itself inside the weft insertion region 124.

In some embodiments, weft position may not be available and/or used. Thus, as further described below, in some embodiments time is used as a comparison metric for valve activation (i.e., distance is not used).

As stated above, in some embodiments, weft thread can move up to about 50 m/sec. If the weft speed sensor 180 (sometimes referred to as a weft position sensor) supplies a pulse every 4 mm, this implies a maximum pulse rate of 25,000 per second.

In some embodiments, each of such pulses from the weft speed sensor 180 results in an interrupt within the controller. However, this can result in a significant load on the controller. In some embodiments, such load may be greater than desired.

Consequently, in some embodiments, pulses from the weft speed sensor 180 are not used to generate interrupts within the controller. Rather, in some embodiments, the controller may comprise a microprocessor having an internal (or external) timer and counter that are used to keep track of the position and velocity.

If a weft speed sensor 180 is not present, the interrupt requirements on the controller may be less stringent.

It should be noted that, in some embodiments, more power may be required to open a valve than to thereafter keep the valve open. Hence, in some embodiments, each valve may be activated (or opened) by a pulse width modulated voltage signal, consisting of an onset voltage pulse having a predetermined magnitude and time period, followed by a regular pulse stream. The onset pulse serves to open the valve and the pulse stream to keep it open. This combination of onset pulse and subsequent pulse stream is hereafter referred to as the pulse width modulated, or PWM, signal.

In some embodiments, the onset voltage pulse has a duration of 10 milliseconds (msec) and the predetermined magnitude comprises a magnitude of a supply voltage and/or a maximum available voltage. In some embodiments, the supply voltage is equal to about 48 volts. In some embodiments, the regular pulse stream comprises a series of pulses having the predetermined magnitude and a duty cycle of ten percent (10%).

In some embodiments, the second controller 204 comprises a microcontroller having logic and timers that may be used to provide the PWM signal. If the number of valves makes it difficult and/or undesirable to provide the PWM signal efficiently in the microcontroller, the second controller 204 may further include circuitry external to the microcontroller, to provide the PWM signal. Some embodiments of the external circuitry that may be used to provide the PWM signal is described below with respect to FIG. 2B.

In some embodiments, the overall cost of the air jet loom is reduced by adding a second controller to activate the air jet valves, thereby reducing the performance requirements and hence the cost of the first controller by reducing and/or eliminating the need for a fine timescale of communication between the first controller and the air jet valves.

In some embodiments, the use of the second controller increases the reliability of weft insertion and hence cloth quality by enabling more accurate control of the valve timings.

Figure 2B:
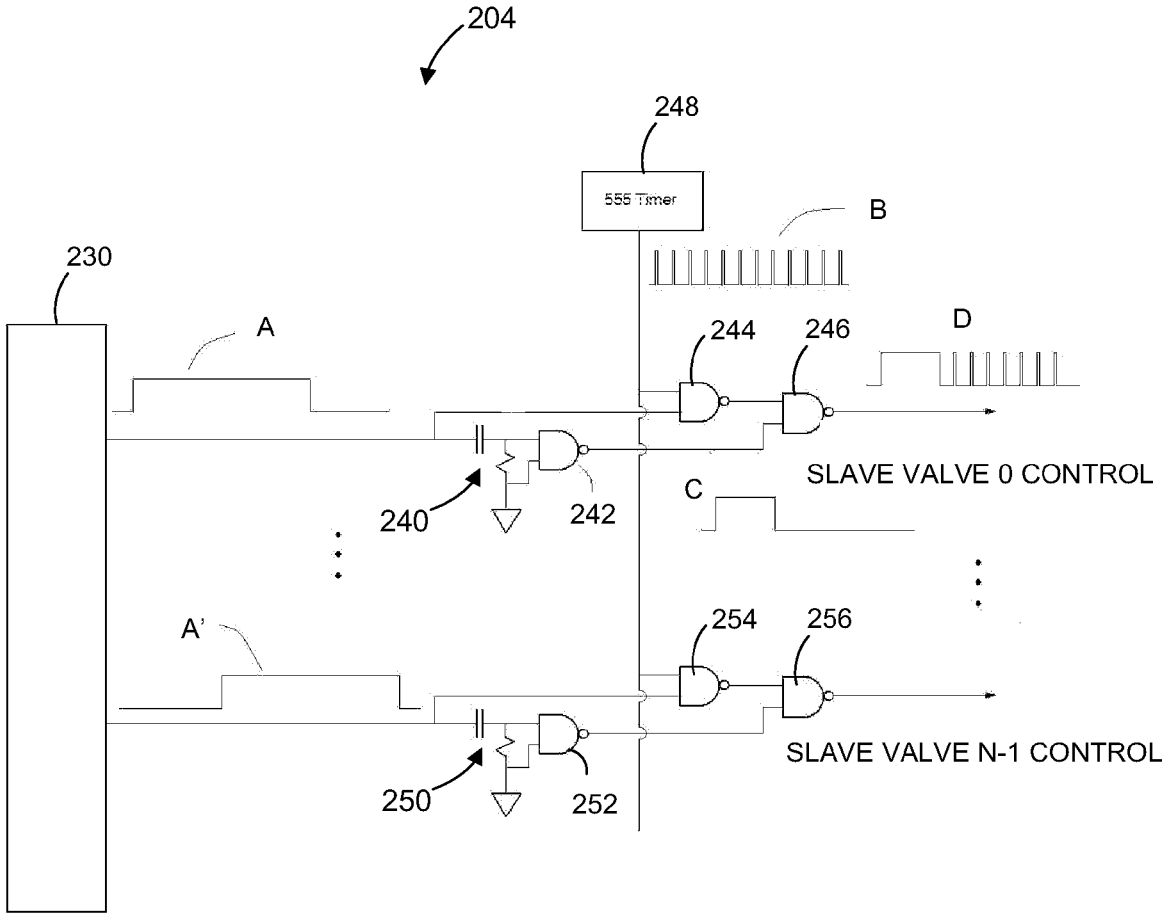
FIG. 2B is a schematic block diagram of a portion of the controller subsystem, in accordance with some embodiments.

FIG. 2B is a schematic block diagram of a portion of the second controller 204, in accordance with some embodiments. Referring to FIG. 2B, in some embodiments, the second controller 204 includes a microcontroller 230 and circuitry to provide the PWM signal for the N slave valves 142-148.

In such embodiments, the microcontroller 230 may supply a plurality of control signals without PWM. The plurality of control signals may include a first control signal (one embodiment of which is indicated at A), which may be supplied to a high pass RC filter 240. This first control signal is a pulse whose width corresponds to the time that the valve is to be held open. An output of the high pass RC filter may be supplied to a first input of a first NAND gate 242, a second input of which may be grounded. The first control signal may also be supplied to a first input of a second NAND gate 244, a second input of which may receive a pulse train (one embodiment of which is indicated at B) from a timer 248. An output of the first NAND gate 242 (one embodiment of which is indicated at C) and an output of the second NAND gate 244 may be supplied to a first input and a second input, respectively, of a third NAND gate 246. An output of the third NAND gate 246 (one embodiment of which is indicated at D) may supply the slave valve 0 control signal to be supplied to the actuator of slave valve 0, represented by valve 142 (FIG. 1).

In some embodiments, the slave valve 0 control signal essentially spans the time period of the first control signal, but instead of being 'on' steadily for the full time span of the first control signal, the slave valve 0 control signal is 'on' steadily for a short time and then pulses until the end of the time span of the first control signal.

The plurality of control signals supplied by the microcontroller may further include an Nth control signal (one embodiment of which is indicated at A'), which may be supplied to a high pass RC filter 250. An output of the high pass RC filter may be supplied to a first input of a NAND gate 252, a second input of which may be grounded. The Nth control signal may also be supplied to a first input of a NAND gate 254, a second input of which may receive the pulse train from the timer 248. An output of the NAND gate 252 and an output of the NAND gate 254 may be supplied to a first input and a second input, respectively, of a NAND gate 256. An output of the NAND gate 256 may supply the slave valve N−1 control signal to be supplied to the actuator of slave valve N−1, represented by valve 148 (FIG. 1).

In operation, the plurality of control signals supplied by the microcontroller 230 may each have a respective pulse, e.g., as shown. (It should be noted, however, that each of the plurality of signals may not have the same pulse width as one another.) Each signal supplied by the PWM circuitry may have an overall width that is the same as that of the respective control signal supplied thereto, however, the regular pulse stream supplied by the PWM circuitry may be supplied by circuitry associated with the timer chip 248.

In some embodiments, the plurality of control signals supplied by the microcontroller 230 may further include a signal associated with the master valve 140 (FIG. 1). The second controller 204 may further include circuitry to provide the PWM signal for the master valve 140 (FIG. 1). In some embodiments, such circuitry may be the same as and or similar to the circuitry used to provide the PWM signal for any of the slave valves 142-148 (FIG. 1).

Figure 3:
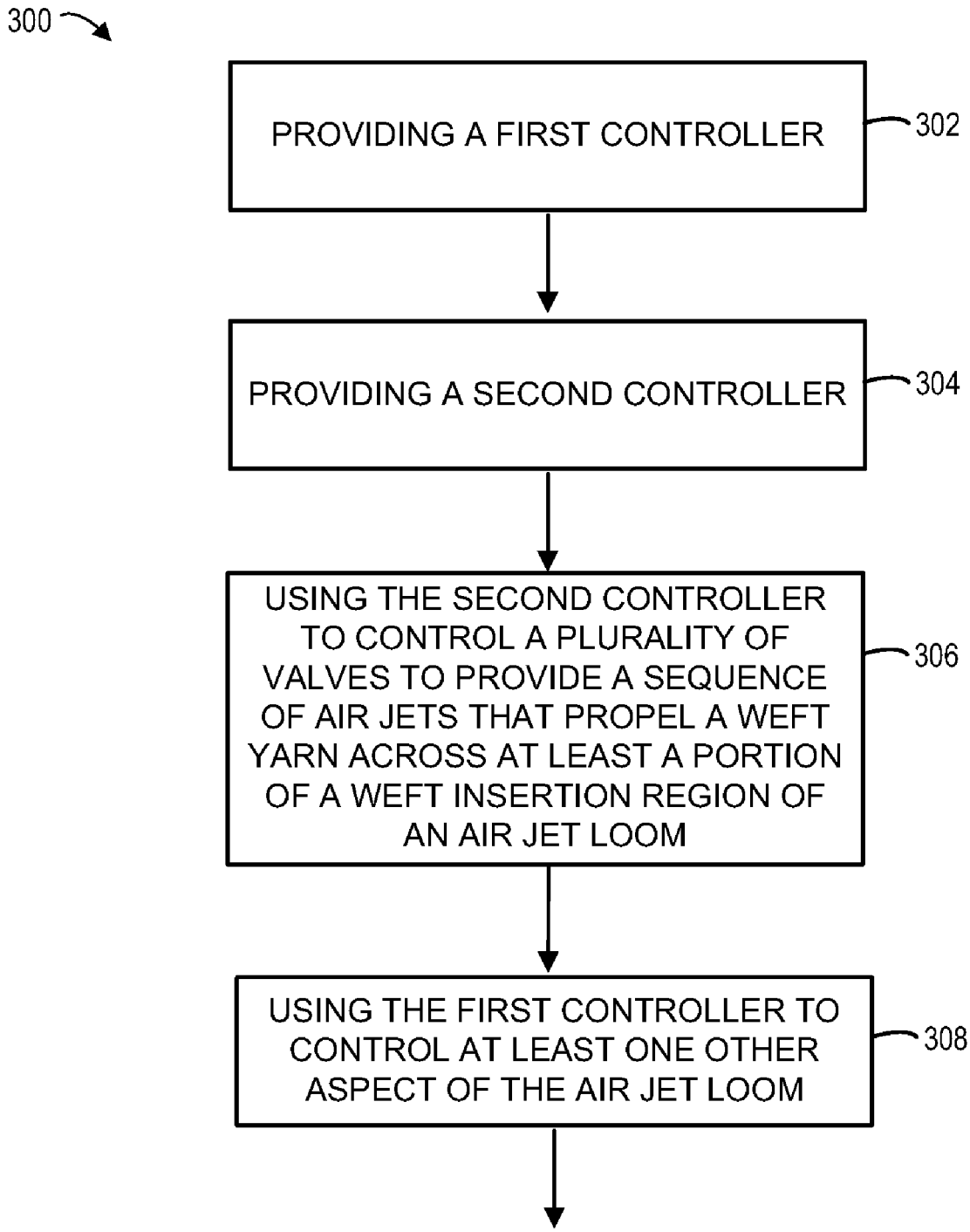
FIG. 3 is a flow chart of a method, in accordance with some embodiments.

FIG. 3 is a flow diagram of a process 300 according to some embodiments. In some embodiments, one or more portions of the process 300 may be employed in association with the air jet loom 100 (FIG. 1) and/or one or more portions thereof.

The process 300 is not limited to the order shown in the flow chart. Rather, embodiments of the process 300 may be performed in any order that is practicable. For that matter, unless stated otherwise, any process disclosed herein may be performed in any order that is practicable. Moreover, some embodiments may employ one or more portions of the process without one or more other portions of the process.

Referring to FIG. 3, at 302, the process may include providing a first controller. In some embodiments, this comprises providing a first controller that is the same as and/or similar to the first controller 202 (FIG. 2A).

At 304, the process may further include providing a second controller. In some embodiments, this comprises providing a second controller that is the same as and/or similar to the second controller 204 (FIG. 2A).

At 306, the process may further include using the second controller to control a plurality of valves to provide a sequence of air jets that propel a weft yarn across at least a portion of a weft insertion region of an air jet loom. In some embodiments, the plurality of valves comprise fewer than all of the air jets of the air jet loom. In such embodiments, the plurality of air jets propel the weft yarn less than completely across the weft insertion region. In some other embodiments, the plurality of valves comprise a plurality of air jets that propel the weft yarn completely across the weft insertion region.

At 308, the process may further include using the first controller to control at least one aspect of the air jet loom not controlled by the second controller.

The process 300 may be performed in any manner. In that regard, in some embodiments, one or more portions of the process 300 and/or any other process disclosed herein may be performed by one some or all portions of the air jet loom 100 illustrated in FIG. 1. In some embodiments, one or more portions of any process disclosed herein may be performed by a controller subsystem. In some such embodiments, the controller subsystem may comprise the controller subsystem 116 (FIG. 1).

In some embodiments, the controller subsystem 116 (FIG. 1) adjusts one or more parameters of the air jet loom 100 (FIG. 1) so as to improve one or more performance characteristics thereof. In some embodiments, an adjustment may be performed after a new roll of thread is started, so as to reduce and/or eliminate the need for the manual adjustment that would typically be made to the timing after the new roll is started.

In some embodiments, an adjustment to the one or more parameters of the air jet loom 100 (FIG. 1) are performed by determining a desired loom configuration and controlling the air jet loom in accordance therewith.

Figure 4:
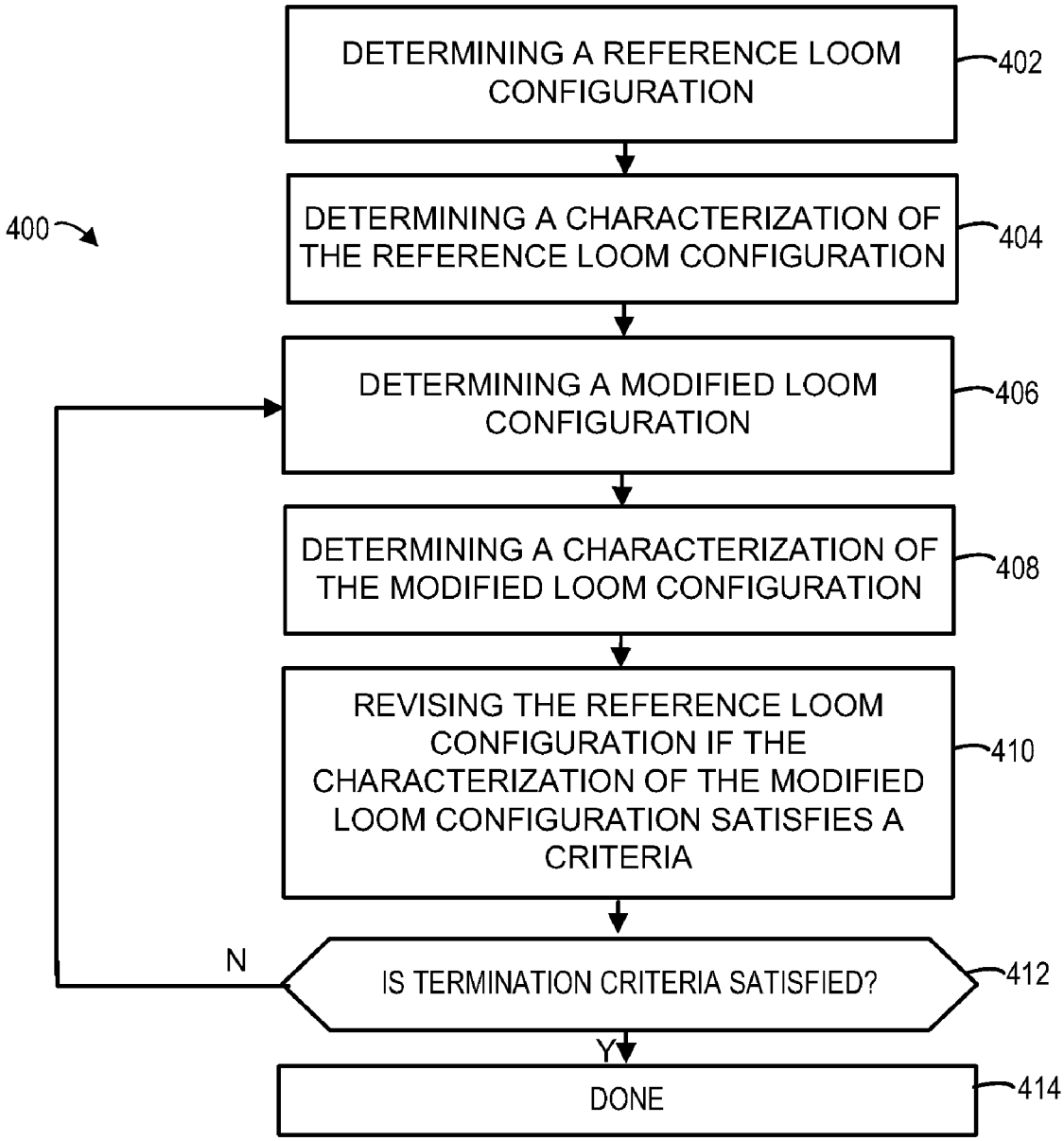
FIG. 4 is a flow chart of a method, in accordance with some embodiments.

FIG. 4 is a flow diagram of a process 400 for use in determining a loom configuration, according to some embodiments. In some embodiments, one or more portions of the process 400 may be employed in association with the air jet loom 100 (FIG. 1) and/or one or more portions thereof. In some embodiments, one or more portions of the process illustrated in FIG. 4 may be employed in adjusting and/or optimizing the configuration of the air jet loom 100 (FIG. 1).

Referring to FIG. 4, at 402, the process may include defining a reference loom configuration. In some embodiments, the reference loom configuration is defined at least in part by a parameter vector and determined using a random search, as described below with respect to FIG. 6.

At 404, the process may further include determining a characterization of the reference loom configuration. In some embodiments, the characterization may be based at least in part on (i) a measure of reliability of the air jet loom in the reference loom configuration and/or (ii) a measure of efficiency of the air jet loom in the reference loom configuration. In some embodiments, measure of reliability is defined as the reliability of weft insertion in the reference loom configuration (i.e., whether the weft thread reliably traverses the weft insertion region with the air jet loom in the reference loom configuration). In some embodiments, the measure of efficiency is defined as the amount of air used by the air jet loom in the reference loom configuration.

At 406, the process may further include determining a modified loom configuration by at least one change to the reference loom configuration. In some embodiments, the at least one change may include (i) a change to criteria used in determining when to actuate one or more of the air jet valves and/or (ii) a change to the air pressure. In some embodiments, the at least one change may be determined randomly. In some other embodiments, the at least one change may be predetermined and/or defined by a predetermined process. In some embodiments, the modified loom configuration is defined at least in part by a parameter vector and determined using one or more portions of the processes described below with respect to FIGS. 5-6. In some embodiments, determining a modified loom configuration comprises determining a midpoint (or other point) between two parameter vectors that result in traverse failure and bound a solution region, as described below with respect to FIGS. 5-6

At 408, the process may further include determining a characterization of the modified loom configuration. In some embodiments, the characterization may be based at least in part on (i) a measure of reliability of the air jet loom in the modified loom configuration and/or (ii) a measure of efficiency of the air jet loom in the modified loom configuration. In some embodiments, the measure of reliability is defined as the reliability of weft insertion in the modified loom configuration (i.e., whether the weft thread reliably traverses the weft insertion region with the air jet loom in the modified loom configuration). In some embodiments, the measure of efficiency is defined as the amount of air used by the air jet loom in the modified loom configuration.

At 410, the process may further include revising the reference loom configuration if the characterization of the modified loom configuration satisfies a criteria. Satisfying the criteria may indicate that the modified loom configuration may be better than the reference loom configuration in one or more respects.

In some embodiments, the reference configuration is defined at least in part by a parameter vector and revising the reference loom configuration comprises revising the reference loom configuration if a parameter vector defining the modified loom configuration, at least in part, is closer (than the parameter vector defining the reference loom configuration, at least in part) to an approximate center of a solution region, as described below with respect to FIGS. 5-6.

At 412, the process may further include determining whether a termination criteria is satisfied. If the termination criteria is satisfied, the process may be complete and may proceed to 414. If the termination criteria is not satisfied, the process may return to 406. In some embodiments, 406-410 may be repeated until the termination criteria is satisfied.

In some embodiments, the reference configuration is defined at least in part by a parameter vector and determining whether a termination criteria is satisfied comprises determining whether the parameter vector defines an approximate center of a solution region, as described below with respect to FIGS. 5-6.

In some embodiments, the process set forth in FIG. 4 may include determining tens, hundreds, thousands, tens of thousands, hundreds of thousands or more modified loom configurations.

In some embodiments, one or more portions of the process illustrated in FIG. 4 may be employed in adjusting and/or optimizing the configuration of the air jet loom 100 (FIG. 1). In some embodiments, the controller subsystem 116 controls the air jet loom 100 in accordance with the reference configuration.

In some embodiments, in an adaptation phase, an adaptive search is done over the control parameters to obtain performance that is in some sense optimal. However, in some embodiments, because the primary feedback signal (success/failure of weft insertion) for the optimality criteria is of such low grade (i.e., binary and infrequent) standard optimization methods such as gradient ascent can't be employed. However, in some embodiments, it is desirable to avoid the worst case, which is to use a brute force combinatorial approach. Such brute force combinatorial approach could easily lead to a situation where a whole roll's worth of yarn would be used up before the air jet loom is adapted to weave it.

In accordance with some embodiments, it is desirable to find a way of reducing the number of parameters to adapt, as well as to streamline the search to avoid having to potentially check every possible parameter space configuration. Some embodiments address these issues by mapping the valve on and off positions to a reduced set of parameters, and by employing line searches to find the center of the solution region (in this reduced parameter space). In some embodiments, the parameters to be adapted comprise the parameters listed in TABLE 2.

TABLE 2

| PARAMETER NAME | DESCRIPTION |
|---|---|
| p[0] | the distance from valve turn-on location to the valve's physical location [0 . . . 127 (ticks)] |
| p[1] | lag distance for valve turn off [0 . . . 127 (ticks)] |
| p[2] | main nozzle pressure level (1, 2, or 3) |
| p[3] | slave nozzle pressure level (1, 2, or 3) |

TABLE 2-continued

| PARAMETER NAME | DESCRIPTION |
|---|---|
| p[4] | Estimated velocity of the weft [0..65251 (ticks/second)] |

Note that, in some embodiments, p[4] is only used in the case where no speed sensor 180 is present. Thus, in some embodiments, the number of parameters is equal to four (4) if a speed sensor 180 is present and five (5) if the speed sensor 180 is not present. If the loom includes a speed sensor 180, the mapping between these four control parameters and the (2*nv) valve on and off settings are:

$$\text{X_on}[k] = Xv[k] - p[0] - \text{time_lag_on} * \text{X_dot_estimate} \quad \text{(eq. 1)}$$

$$\text{X_off}[k] = \text{X_on}[k] + \text{X_SPAN_VENT} + p[1] - \text{time_lag_off} * \text{X_dot_estimate} \quad \text{(eq. 2)}$$

Where:

k=0 . . . nv−1

Xv[k]: the kth nominal valve position, $$X_\text{dot_estimate}(t) = f * X_\text{dot}(t) + (1-f) * X_\text{dot_estimate}(t-1) \quad \text{(eq. 3)}$$

$$X_\text{dot}(t) = \text{weft velocity} = X_\text{dot}(t) = 0.004/(\text{time(tick)} - \text{time(tick}-1)),$$

where t is an index (0, 1, 2, . . . ) where each increment in t typically corresponds to the passage of a constant time interval (e.g., 0.0001 seconds).

time(tick) is the time measured at the most recent position sensor tick, time(tick−1) is the time for the tick prior to that one (this variable only applies when a speed sensor is present), f=constant (expected to be about 0.2, note that this value is strongly dependent on the how often the filter is updated), X_SPAN_VENT=constant representing the shortest possible expected span between the valve-on and valve-off positions, and time_lag_on, time_lag_off=the effective lag times for the valve become fully on or fully off, respectively.

So, for example, when the computed position of the weft thread (X_weft=sum of the ticks from the speed sensor) just exceeds (or comes within some predefined small threshold) to X_on[0], the first valve is turned on, and when the weft reaches X_off[0] the valve is turned off. Note that eq. 3 would need to be updated frequently preferably at evenly spaced time intervals (e.g., every 100 microseconds, i.e., at t=0, 0.0001, 0.0002, . . . ). Eqs. 1 and 2 could be updated as often as eq. 3, or less, depending on how close the weft position is to a given valve on or off position (e.g., as the weft approaches X_on[0] it would be desirable to calculate X_on[0] every time eq. 3 is computed, but after valve 0 has been turned on it is no longer necessary to compute eq. 1 for valve 0).

In some embodiments, the X_SPAN_VENT constant is included only to reduce the number of bits needed to express parameter p[2], or conversely, given a number of bits for p[2], to increase the positional resolution represented by p[2].

Note that in some embodiments, a significant amount of time (compared to the total traverse time) is required for a valve to open and for the air velocity within the valve to reach full speed. The period between the valve-on command and the time that the valve is fully open and the air flow is at full speed is sometimes referred to herein as the valve-on lag period (time_lag_on). Conversely, the period between the valve-off command and the time that the valve is fully closed and the air flow is stopped is sometimes referred to herein as the valve-off lag period (time_lag_off).

One way to estimate the valve-on lag period with reasonable performance is to use the most recent estimation of the weft velocity and assume that this value is constant over the valve (on or off) lag period. However, because velocity measurements may be intrinsically noisier than position measurements, it may be desirable to use a low pass filtered version of the velocity for the estimation, and to have this filter weight most recent velocity measurements higher than older measurements. Equation 3 above employs such an approach in determining X_dot_estimate.

Note that time_lag_on and time_lag_off can be measured experimentally, but can also be estimated during the adaptation phase. However, to keep the number of parameters low it may be best to determine the values for time_lag_on and time_lag_off beforehand (e.g., prior to the adaption phase) and insert them manually. Since the velocity variation from insertion to insertion (and across different thread materials) may not be that great, errors in these terms may only have a second order effect on the optimality.

In any case, and as described earlier, in some embodiments, each valve is activated after comparing the weft position (as determined based on the signal from the weft speed sensor) and the on and off valve positions as determined in the above equations. As stated above, in some embodiments, the weft position X_weft is defined as the number of ticks from the weft speed sensor.

As stated above, in some embodiments, the loom does not include a weft speed sensor and the weft velocity is assumed to be constant over the traverse. In some such embodiments, the mapping between the four control parameters and the (2*nv) valve on and off settings may be as follows:

$$X_\text{on}[k]=Xv[k]-p[0] \quad \text{(eq. 4)}$$

$$X_\text{off}[k]=X_\text{on}[k]+X_\text{SPAN_VENT}+p[1] \quad \text{(eq. 5)}$$

where the various quantities are defined as set forth above.

It should be noted that, because the weft velocity is assumed to be constant over the traverse, equations 4 and 5 for the valve on and off positions, respectively, are less complex than equations 1 and 2, respectively, set forth above. (It should also be noted that, in accordance with some embodiments, the lag times for the valves are essentially factored out since the velocity is constant). However, in this case, control parameter p[4] may be used to estimate the position of the weft (assuming constant weft velocity) as follows:

$$X_dot_\text{estimate}=p[4] \quad \text{(eq. 6)}$$

and thus $$X_\text{weft}=X_\text{dot_estimate}*\text{time} \quad \text{(eq. 7)}$$

Figure 5:
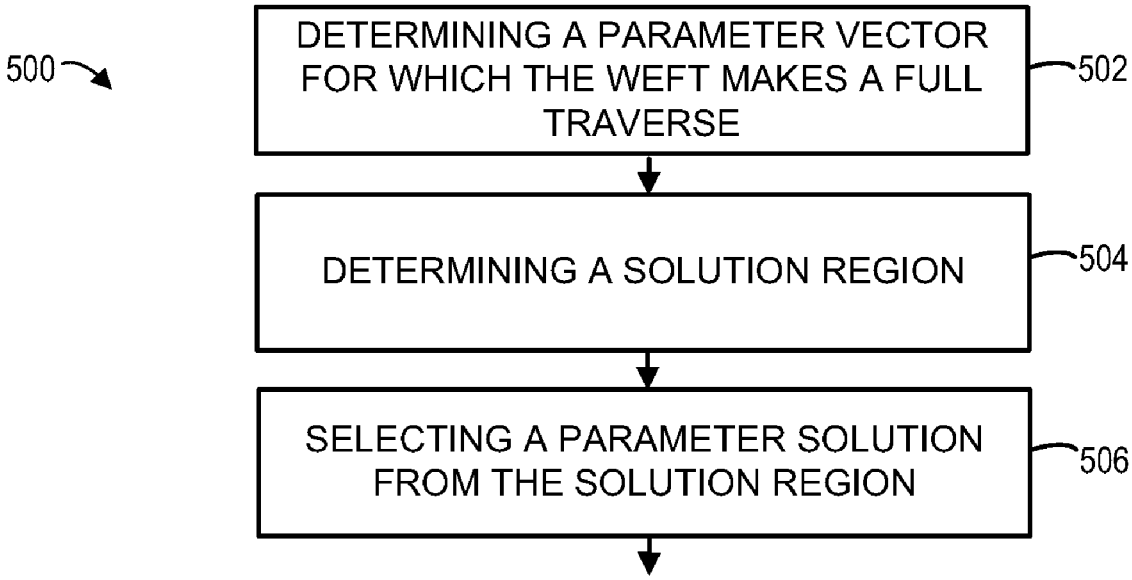
FIG. 5 is a flow chart of a method, in accordance with some embodiments.

FIG. 5 is a flow diagram of a process 400 that includes an adaptive search, in accordance with some embodiments. In some embodiments, one or more portions of the process are used in the process 400 (FIG. 4). In some embodiments, the adaptive search is performed with a reduced parameter set. In some embodiments, the reduced parameter set is a reduced parameter set described above.

Referring to FIG. 5, at 502, the process may include determining a parameter vector for which the weft makes a full traverse (i.e., completely across the weft insertion region). In accordance with some embodiments, the parameter vector defines an air jet loom configuration, at least in part. In some embodiments, the parameter vector for which the weft makes a full traverse is determined using a random search.

At 504, the process may further include determining a solution region. In some embodiments, the solution region comprises a solution hyper-volume bounded (defined) by parameter vectors that result in traverse failure.

In some embodiments, the solution volume is determined only after determining the parameter vector for which the weft makes a full traverse (i.e., completely across the weft insertion region). Some embodiments determine the solution volume by performing a sequence of one-dimensional searches (sometimes referred to herein as parameter searches).

In some embodiments, each one-dimensional search consists of taking steps in the parameter space of length p_step_size[i], where 'i' is a parameter index.

In some directions of the parameter space, the solution space may be unbounded. For example, if air consumption is not an issue it may be best to leave on each valve after it is turn on for the duration of the traverse.

At 506, the process may further include selecting a parameter solution from the solution region. In some embodiments, the parameter solution is selected based at least in part on a characterization of the parameter solution. In some embodiments, this characterization is defined as a "goodness" of the parameter solution.

In some embodiments, the "goodness" of a parameter solution is based at least in part on: 1) the reliability of the weft insertion (i.e., whether the weft thread reliably traverses the weft insertion region with the parameter solution), and 2) the amount of air used by the air jet loom (less is better).

In some embodiments, a parameter solution with the most reliable weft insertion corresponds to a midpoint between two parameter vectors that result in traverse failure (and bound the solution volume), since the midpoint is the "furthest" from these two failure vectors.

Thus, in some embodiments, the process further includes determining an approximate center of the solution volume If two parameter vectors that result in traverse failure differ in only one dimension, e.g., a kth parameter, the value of the kth parameter at the midpoint between such two parameter vectors may be expressed as:

$$P_{k,sol}(i)=(P_{k,Lo}(i)+P_{k,hi}(i))/2 \quad \text{(eq. 8)}$$

where 'i' refers to the $i^{th}$ step in the optimization process, $P_{k,Lo}(i)$ and $P_{k,hi}(i)$ are the low and high values for the $k^{th}$ parameter corresponding to either 1) a traverse failure, or 2) the prescribed limit for that parameter. Eq. 8 represents the optimal value of the $k^{th}$ parameter for the $i^{th}$ step in the optimization process. The overall optimization process, as described in more detail below, involves performing a number of parameter adjustments according to eq. 8 (or eq. 10 below), i.e., it involves an iterative process to find the final solution to all the parameter values.

An equation for the air consumption (A) is:

$$A\sim\Sigma_k(X_on(k)-X_off(k))\sim p[2] \quad \text{(eq. 9)}$$

where '~' stands for "proportional to," and '$\Sigma_k$' means the sum over the possible values of k.

Thus, the air consumption (A) is proportional to p[2] (i.e., the air pressure). In that regard, in some embodiments, the lowest possible value of p[2] (i.e., the air pressure) is desired in order to minimize the air consumption.

Hence, in some embodiments, the optimal solution for parameters p[0], p[2], and p[3] corresponds to eq. 8. For parameter p[1], the optimal value for a search step is defined by eq. 10:

$$P_{1,sol}(i) = (1-w)P_{1,Lo}(i) + w(P_{1,Lo}(i) + P_{1,hi}(i))/2 \quad \text{(eq. 10)}$$
$$= w/2(P_{1,hi}(i) - P_{1,Lo}(i)) + P_{1,Lo}(i)$$

where w=optimization_criteria/255.

It should be noted that, for eq. 10, if w=0, the optimal solution corresponds to $P_{1,Lo}(i)$, and if w=1, the optimal value for the search step is defined by eq. 8, i.e., $(P_{1,Lo}(i)+P_{1,hi}(i))/2$.

Figure 6:
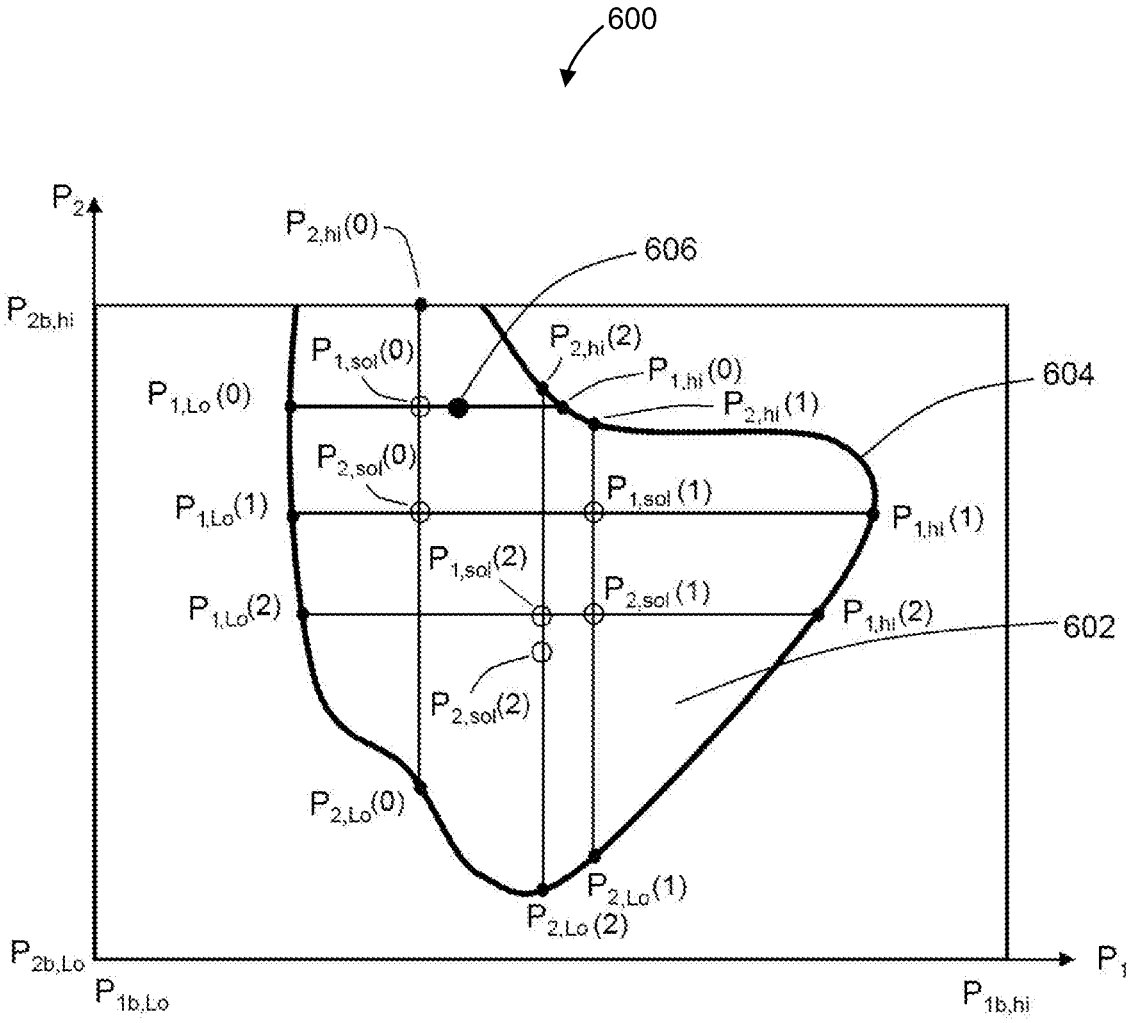
FIG. 6 is a schematic diagram of an adaptive search, in accordance with some embodiments.

FIG. 6 is a schematic diagram 600 of an adaptive search for parameters p[1] and p[2] (ignoring parameters p[0] and p[4], i.e., treating parameters p[0] and p[4] as though they do not exist), in accordance with some embodiments. Referring to FIG. 6, the schematic diagram 600 includes a first axis, indicated at P1, and a second axis, indicated at P2. The first axis is associated with the parameter p[1]. The second axis is associated with the parameter p[2].

The diagram further includes solution region 602 partly bounded (defined) by parameter vectors 604 that result in traverse failure. The diagram further includes a first parameter vector, indicated by circle 606, that results in a full traverse (i.e., a traverse success). In some embodiments, the first parameter vector 606 is determined using a random search. For the initial random search for some embodiments, a uniform distribution is assumed over the rectangle defined by user-specified bounds in the parameters, in particular, by $P_{1b,Lo}$ and $P_{1b,hi}$ for parameter $P_1$, and by $P_{2b,Lo}$ and $P_{2b,hi}$ for parameter $P_2$.

A final parameter solution is indicated by $P_{2,sol}(\mathbf{2})$ and in some embodiments, may be determined by performing a sequence of single parameter searches which discover two bounds of the solution volume corresponding to "line searches" in opposite directions from an initial solution point. A line search consists of tests for a successful traverse corresponding to a sequence of small steps away from the given initial solution point in a given direction (either the plus or the minus parameter direction). Once the two bounds are determined, the solution point between the two bounds is determined using the optimization criteria (e.g., eq. 10), and this point is the starting point for the next line search for the next parameter. This process continues for each parameter and then the whole process is repeated, but starting from the last solution point found. The search ends after some predefined criterion is met, such as convergence in the parameters values, or some predefined number of line searches has occurred. The example search in FIG. 6 is now described in more detail.

The diagram in FIG. 6 further includes a second parameter vector, indicated at $P_{1,hi}(\mathbf{0})$, which results in a traverse failure (for the first search for the first parameter). In some embodiments, the second parameter vector is determined by a first parameter search (sometimes referred to herein as a line search) that starts at the first parameter vector 606. In accordance with some embodiments, the first parameter search is in the positive p[1] direction (denoted by $P_1$ in the figure). In such embodiments, the first parameter search changes the value of p[1] by an index in the positive p[1] direction until a traverse failure occurs at the second parameter vector, indicated at point $P_{1,hi}(\mathbf{0})$.

In accordance with some embodiments, each change described above and hereafter may define (directly or indirectly) a new parameter vector. The air jet loom may be configured according to such parameter vector and tested to determine the reliability of the traverse with the air jet loom configured according to such parameter vector.

The diagram further includes a third parameter vector, indicated at $P_{1,Lo}(\mathbf{0})$, which results in a traverse failure. In some embodiments, the third parameter vector is determined by a second parameter search that starts at the at the first parameter vector 606. In accordance with some embodiments, the third parameter is in the negative p[1] direction. In such embodiments, the second parameter search changes the value of p[1] by an index in the negative p[1] direction until a traverse failure occurs at the third parameter vector, indicated at $P_{1,Lo}(\mathbf{0})$.

The diagram further includes a solution point, indicated at $P_{1,sol}(\mathbf{0})$. In some embodiments, the solution point $P_{1,sol}(\mathbf{0})$ is computed using eq. 10 (k=1).

The diagram further includes a fourth parameter vector, indicated at $P_{2,hi}(\mathbf{0})$, which in the illustrated embodiment does not result in a traverse failure (this bound could correspond to the end of the traverse). In some embodiments, the fourth parameter vector is determined by a third parameter search (sometimes referred to herein as a line search) in the positive p[2] direction, starting from the previous line search solution, in this case $P_{1,sol}(\mathbf{0})$. This fourth parameter search changes the value of p[2] by an index in the positive p[2] direction until the bound is reached, indicated at $P_{2,hi}(\mathbf{0})$, (which as stated above, may not a traverse failure—this bound could correspond to the end of the traverse).

The diagram further includes a fifth parameter vector, indicated at $P_{2,Lo}(\mathbf{0})$, which results in a traverse failure. In some embodiments, the fifth parameter vector is determined by a fourth parameter search in the negative p[2] direction, again starting from $P_{1,sol}(\mathbf{0})$. This fourth parameter search changes the value of p[2] by an index in the negative p[2] direction results in a traverse failure at the fifth parameter vector, indicated at $P_{2,Lo}$.

The diagram further includes a solution point, indicated at $P_{2,sol}(\mathbf{0})$. In some embodiments, the solution point $P_{2,sol}(\mathbf{0})$ is computed using eq. 10.

This completes one search pass through the parameters p[1] and p[2], corresponding to i=0 in eqs. 8 or 10.

The diagram shows two more passes (with two line searches per pass) through the parameters p[1] and p[2] resulting in the final solution $P_{2,sol}(\mathbf{2})$. In some embodiments, this includes a fifth parameter search that changes the value of p[1] by an index in the positive p[1] direction until a traverse failure occurs at a parameter vector, indicated at point $P_{1,hi}(\mathbf{1})$. A sixth parameter search may change the value of p[1] by an index in the negative p[1] direction until a traverse failure occurs at a parameter vector, indicated at point $P_{1,Lo}(\mathbf{1})$. A solution point $P_{1,sol}(\mathbf{1})$ may be computed using eq. 10. A seventh parameter search may change the value of p[2] by an index in the positive p[2] direction until a traverse failure occurs at a parameter vector, indicated at point $P_{2,hi}(\mathbf{1})$. An eighth parameter search may change the value of p[2] by an index in the negative p[2] direction until a traverse failure occurs at a parameter vector, indicated at point $P_{2,Lo}(\mathbf{1})$. A solution point $P_{2,sol}(\mathbf{1})$ may be computed using eq. 10.

A ninth parameter search may change the value of p[1] by an index in the positive p[1] direction until a traverse failure occurs at a parameter vector, indicated at point $P_{1,hi}(\mathbf{2})$. A tenth parameter search may change the value of p[1] by an index in the negative p[1] direction until a traverse failure occurs at a parameter vector, indicated at point $P_{1,Lo}(\mathbf{2})$. A solution point $P_{1,sol}(\mathbf{2})$ may be computed using eq. 10. An eleventh parameter search may change the value of p[2] by an index in the positive p[2] direction until a traverse failure occurs at a parameter vector, indicated at point $P_{2,hi}(2)$. A twelfth parameter search may change the value of p[2] by an index in the negative p[2] direction until a traverse failure occurs at a parameter vector, indicated at point $P_{2,Lo}(2)$. A solution point $P_{2,sol}(2)$ may be computed using eq. 10.

As stated above, if the air jet loom 100 does not include a weft speed sensor 180 the valve timings may be based at least in part on the weft position as it moves through the system as determined by an estimated weft velocity. In some embodiments, the weft velocity is assumed to be constant throughout the weft traverse. Only one parameter may be needed to express the constant velocity. In some other embodiments, more elaborate profiles may be desired. More parameters may be needed to express such profiles. For example, the profile could be a linear function with two parameters, i.e., the slope and y intercept of the velocity profile. Or, an even more elaborate profile could be a "rotated sigmoid" velocity profile. In some embodiments, such "rotated sigmoid" velocity profile may comprise a "rotated sigmoid" velocity profile such as described by Kayacan et al, "Velocity control of weft insertion on air jet looms by a fuzzy logic," FIBRES & TEXTILES in Eastern Europe July/October 2004, Vol. 12, No. 3(47).

Some embodiments do not include a capability for adaptation, that is, for automatic tuning of the valve activation timings. In some such embodiments, the second controller primarily performs a timer function. In such embodiments, the control parameters supplied to the second controller from the first controller may comprise the parameters listed in TABLE 3.

TABLE 3

| PARAMETER NAME | DESCRIPTION |
|---|---|
| nv | Number of valves [one byte] |
| (T_on[0], T_off[0], T_on[1], T_off[1], . . . , T_on[nv − 1], T_off[nv − 1]) | time in milliseconds since the beginning of the cycle start for turning on and off the nv valves [2 bytes for each time] |

In some embodiments the first controller 202 performs the adaptive search calculations and supplies updated valve timing information to the second controller 204. In some embodiments, the first controller 202 supplies the updated timing information before each weft insertion. In some such embodiments, the purpose of the second controller 204 may be primarily to perform a timer function.

In some embodiments, the first controller 202 comprises a digital microcontroller and the second controller 204 comprises an analog type controller that includes primarily analog components and does not include a digital microcontroller. In some embodiments, an analog type controller may offer speed and/or other advantages to the air loom jet system.

In some embodiments, automatic tuning increases the reliability of weft insertion and hence cloth quality by enabling more accurate control of the valve timings.

In some embodiments, automatic tuning offers the capability of automatically finding reliable and efficient timing control settings of the valves, reducing and/or eliminating the need for costly and time-consuming manual intervention.

Figure 7:
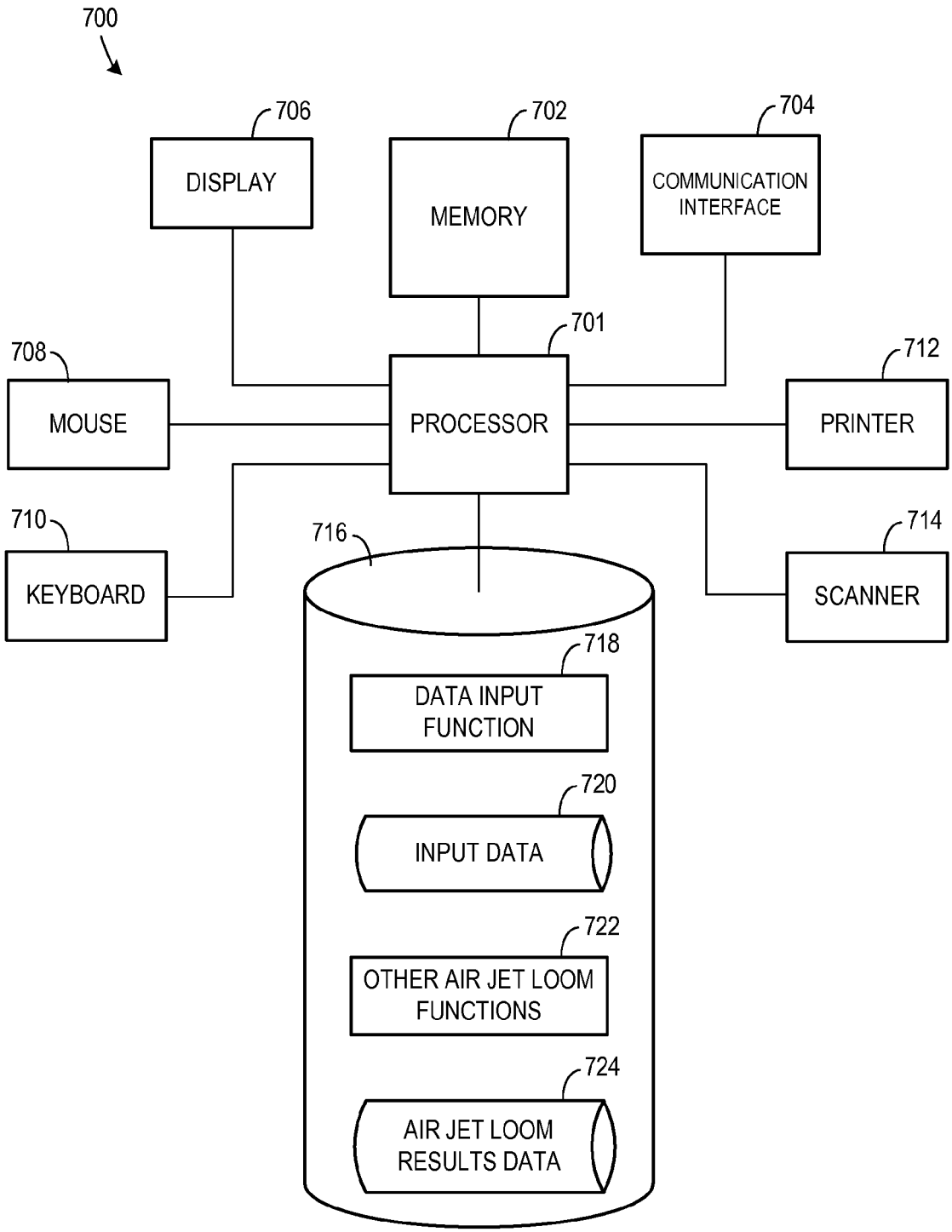
FIG. 7 is a schematic block diagram of a controller, in accordance with some embodiments.

FIG. 7 is a block diagram of a controller 700 (FIG. 1) in accordance with some embodiments. Referring to FIG. 7, in some embodiments, the controller 700 may include a microcontroller 701, which may be a microprocessor. The controller may further include memory 702 in communication with the microcontroller 701. The memory 702 may be, in some embodiments, one or more of RAM, ROM, flash memory, etc., and may serve as one or more of working memory, program storage memory, etc.

In some embodiments, the controller 700 may further include a communication interface 704. The communication interface 704 may, for example, allow the controller 700 to access information.

The controller 700 may further include a number of different input/output devices, including, for example, a display 706, a conventional pointing device such as a mouse 708, a keyboard 710 and a printer 712.

The controller 700 may further include a mass storage device 716. Mass storage device 716 may comprise one or more magnetic storage devices, such as hard disks, one or more optical storage devices, and/or solid state storage. The mass storage 716 may store software 718 to be executed by the controller 700 to perform a method including receiving input data. In some embodiments, the input data may be stored in one or more portions 720 of the mass storage 716. The mass storage 716 may also store software 722 to be executed by the controller 700 to perform one or more other air jet loom functions. In some embodiments, the one or more other air jet loom functions include one or more portions of one or more processes disclosed herein. In some embodiments, the mass storage 716 may also store operating system software and/or other applications that may be executed by the controller 700 to perform other functions. Still further, the mass storage 716 may store results from performing the one or more air jet loom functions. It will be appreciated that all of the software referred to above may be temporarily stored in memory 702 and fetched by the microcontroller 701. The software may also be referred to as "instructions" or "controller readable program code".

In some embodiments one or more portions of the controller subsystem 116 may be the same as and/or similar to one or more portions of the controller 700. In some embodiments, one or more portions of the first controller 202 (FIG. 2A) and/or one or more portions of the second controller 204 (FIG. 2A) may be the same as and/or similar to one or more portions of the controller 700.

Unless stated otherwise, terms such as, for example, "supply to" mean "supply directly to and/or supply indirectly to". In addition, unless stated otherwise, the term "connected to" means "connected directly to and/or connected indirectly to".

Unless otherwise stated, terms such as, for example, "in response to" and "based on" mean "in response at least to" and "based at least on", respectively, so as not to preclude being responsive to and/or based on, more than one thing.

In addition, unless stated otherwise, terms such as, for example, "comprises", "has", "includes", and all forms thereof, are considered open-ended, so as not to preclude additional elements and/or features. In addition, unless stated otherwise, terms such as, for example, "a", "one", "first", are considered open-ended, and do not mean "only a", "only one" and "only a first", respectively. Moreover, unless stated otherwise, the term "first" does not, by itself, require that there also be a "second".

Although various features, attributes and/or advantages may be described herein and/or may be apparent in light of the description herein, it should be understood that unless stated otherwise, such features, attributes and/or advantages are not required and need not be present in all aspects and/or embodiments.

While various embodiments have been described, such description should not be interpreted in a limiting sense. It is to be understood that modifications of such embodiments, as well as additional embodiments, may be utilized without departing from the spirit and scope of the invention, as recited in the claims appended hereto. It is therefore contemplated that the appended claims will cover any such modifications and embodiments.

What is claimed is:

1. A method for a controller in an air jet loom, the method comprising:

(a) defining a reference loom configuration;

(b) determining, by a controller subsystem that includes hardware, a characterization of the reference loom configuration;

(c) determining, by the controller subsystem, a modified loom configuration by at least one change to the reference loom configuration;

(d) determining, by the controller subsystem, a characterization of the modified loom configuration; and (e) revising, by the controller subsystem, the reference loom configuration if the characterization of the modified loom configuration satisfies a criteria;

wherein the determining a modified loom configuration by at least one change to the reference loom configuration comprises:

determining a first parameter vector that results in a traverse failure and bounds a solution region that is bounded at least in part by parameter vectors that result in traverse failure;

determining a second parameter vector that results in a traverse failure and bounds the solution region; and determining a parameter solution that is in the solution region and between: (i) the first parameter vector that results in a traverse failure and bounds the solution region and (ii) the second parameter vector that results in a traverse failure and bounds the solution region.

2. The method of claim 1 further comprising:

determining, by the controller subsystem, whether a termination criteria is satisfied; and if the termination criteria is not satisfied, repeating (c)-(e) until the termination criteria is satisfied.

3. The method of claim 2 further comprising controlling, by the controller subsystem, at least one parameter of the air jet loom based at least in part on the reference loom configuration.

4. The method of claim 2 wherein the at least one parameter comprises an air pressure.

5. The method of claim 2 wherein the at least one parameter comprises timing for at least one valve of the air jet loom.

6. The method of claim 1 wherein the criteria includes a criteria related to a reliability of weft insertion in the air jet loom.

7. The method of claim 1 wherein the criteria includes a criteria related to an amount of air used the air jet loom.

8. Apparatus comprising:

a controller subsystem for an air jet loom, wherein the controller subsystem includes hardware and is to: (a) define a reference loom configuration; (b) determine a characterization of the reference loom configuration; (c) determine a modified loom configuration by at least one change to the reference loom configuration; (d) determine a characterization of the modified loom configuration; and (e) revise the reference loom configuration if the characterization of the modified loom configuration satisfies a criteria;

wherein the determine a modified loom configuration by at least one change to the reference loom configuration comprises:

determine a first parameter vector that results in a traverse failure and bounds a solution region that is bounded at least in part by parameter vectors that result in traverse failure;

determine a second parameter vector that results in a traverse failure and bounds the solution region; and determine a parameter solution that is in the solution region and between (i) the first parameter vector that results in a traverse failure and bounds the solution region and (ii) the second parameter vector that results in a traverse failure and bounds the solution region.

9. The apparatus of claim 8, wherein the controller subsystem is further to determine whether a termination criteria is satisfied, and if the termination criteria is not satisfied, repeat (c)-(e) until the termination criteria is satisfied.

10. The apparatus of claim 9 wherein the controller subsystem is further to control at least one parameter of the air jet loom based at least in part on the reference loom configuration.

11. The apparatus of claim 10 wherein the at least one parameter comprises an air pressure.

12. The apparatus of claim 10 wherein the at least one parameter comprises timing for at least one valve of the air jet loom.

13. The apparatus of claim 8 wherein the criteria includes a criteria related to a reliability of weft insertion in the air jet loom.

14. The apparatus of claim 8 wherein the criteria includes a criteria related to an amount of air used the air jet loom.

15. An article for an air jet loom having a controller, the article including a storage medium readable by the controller, the storage medium having instructions stored thereon that if executed by the controller result in the following:

(a) defining a reference loom configuration;

(b) determining a characterization of the reference loom configuration;

(c) determining a modified loom configuration by at least one change to the reference loom configuration;

(d) determining a characterization of the modified loom configuration; and (e) revising the reference loom configuration if the characterization of the modified loom configuration satisfies a criteria;

wherein the determining a modified loom configuration by at least one change to the reference loom configuration comprises:

determining a first parameter vector that results in a traverse failure and bounds a solution region that is bounded at least in part by parameter vectors that result in traverse failure;

determining a second parameter vector that results in a traverse failure and bounds the solution region; and determining a parameter solution that is in the solution region and between (i) the first parameter vector that results in a traverse failure and bounds the solution region and (ii) the second parameter vector that results in a traverse failure and bounds the solution region.

16. The article of claim 15 wherein the storage medium further has stored thereon instructions that if executed by the controller result in the following:

determining whether a termination criteria is satisfied; and if the termination criteria is not satisfied, repeating (c)-(e) until the termination criteria is satisfied.

17. The article of claim 16 wherein the storage medium further has stored thereon instructions that if executed by the controller result in the following:

controlling at least one parameter of the air jet loom based at least in part on the reference loom configuration.

18. The article of claim 17 wherein the at least one parameter comprises an air pressure.

19. The article of claim 17 wherein the at least one parameter comprises timing for at least one valve of the air jet loom.

20. The article of claim 15 wherein the criteria includes a criteria related to a reliability of weft insertion in the air jet loom.

21. The article of claim 15 wherein the criteria includes a criteria related to an amount of air used the air jet loom.

22. The method of claim 1 wherein the determining a parameter solution between (i) the first parameter vector that results in a traverse failure and bounds the solution region and (ii) the second parameter vector that results in a traverse failure and bounds the solution region comprises:

determining a parameter solution that corresponds to a midpoint between (i) the first parameter vector that results in a traverse failure and bounds the solution region and (ii) the second parameter vector that results in a traverse failure and bounds the solution region.

23. The apparatus of claim 10 wherein the determine a parameter solution between (i) the first parameter vector that results in a traverse failure and bounds the solution region and (ii) the second parameter vector that results in a traverse failure and bounds the solution region comprises:

determine a parameter solution that corresponds to a midpoint between (i) the first parameter vector that results in a traverse failure and bounds the solution region and (ii) the second parameter vector that results in a traverse failure and bounds the solution region.

24. The article of claim 15 wherein the determining a parameter solution between (i) the first parameter vector that results in a traverse failure and bounds the solution region and (ii) the second parameter vector that results in a traverse failure and bounds the solution region comprises:

determining a parameter solution that corresponds to a midpoint between (i) the first parameter vector that results in a traverse failure and bounds the solution region and (ii) the second parameter vector that results in a traverse failure and bounds the solution region.

* * * * *